United States Patent [19]

Reeberg

[11] 4,266,867

[45] May 12, 1981

[54] HOLD STEADY STRAPS

[76] Inventor: Christiaan Reeberg, 111-67 145th St., Jamaica, N.Y. 11435

[21] Appl. No.: 109,655

[22] Filed: Jan. 4, 1980

[51] Int. Cl.[3] ..... G03B 17/00; A44B 21/00

[52] U.S. Cl. ..... 354/293; 24/302

[58] Field of Search ..... 354/293; 24/73 HH, 73 GS, 24/164, 182, 2.5, 200

[56] References Cited

U.S. PATENT DOCUMENTS

| | | | |
|---|---|---|---|
| 77,318 | 4/1868 | Potter | 24/182 |
| 784,721 | 3/1905 | Wenzel et al. | 24/73 GS UX |
| 1,766,090 | 6/1930 | Wörsching | 354/293 X |
| 2,804,742 | 9/1957 | Ray | 24/182 X |
| 3,072,166 | 1/1963 | Von Buchholtz et al. | 354/293 X |
| 3,672,004 | 6/1972 | Smith | 24/73 HH |
| 4,155,636 | 5/1979 | Reeberg | 354/293 |

FOREIGN PATENT DOCUMENTS

| | | | |
|---|---|---|---|
| 1075009 | 4/1954 | France | 354/293 |
| 934033 | 8/1963 | United Kingdom | 354/293 |

*Primary Examiner*—Donald A. Griffin

*Attorney, Agent, or Firm*—Barnwell R. King

[57] ABSTRACT

An auxiliary length-adjustable, flexible non-elastic strap extension is adapted to be connected to the belt hook at the lower end of a waist-to-camera length adjustable hold steady camera strap which is made of non-elastic, flexible material, to convert such waist length strap to a camera-to-foot length strap having a stirrup at its lower end, for holding the hand held camera steady at eye-to-foot level when taking pictures therewith. When not in use, the flexible hold steady strap members and associated hardware are bundled for containment in a transparent plastic bag thereby constituting a compact kit.

2 Claims, 4 Drawing Figures

HOLD STEADY STRAPS

BACKGROUND OF THE INVENTION

This invention relates to hold steady straps for taking pictures with a camera which is hand held at eye level.

A prior art hold steady strap is disclosed in my U.S. Pat. No. 4,155,636 dated May 22, 1979. Such strap is either of waist length, or of foot length, i.e. the waist length strap ends in a belt hook, whereas the foot length strap ends in a foot stirrup. In both types an attachment at the top of the strap is provided with a freely rotatable screw for engaging a threaded opening in the camera, and each also specifically employs a length of elastic webbing that is sewn at one end to such screw attachment and at the other to a non-elastic web portion. This increases the cost of making the straps, and also, since the two types are sold together, increases the amount of material used in as well as the weight due to the required hardware.

The main object of this invention is to reduce the cost and weight; the amount of hardware and material needed, as well the combined size required for such hold steady straps when packaged as a kit.

Another object is to provide an auxiliary foot extension for quick connection to the hook of a waist length hold steady strap for adapting the latter to foot use.

A further object is to provide hold steady straps in which no elastic webbing is used, thereby to increase the life of the straps, especially for outdoor use, such as at sea and in the field.

SUMMARY OF THE INVENTION

The present invention consists of a completely non-elastic hold steady strap of waist length, and a completely non-elastic extension strap having a flat ring at its upper end for connection to the belt hook at the lower end of the waist strap, for connecting the hold steady strap from a belt type hold steady strap to a foot type one; the extension strap having a foot stirrup for such conversion.

Thus, the amount of material is substantially reduced, i.e. by one third, the screw attachments are cut in half—from two to one; and the use of elastic webbing is entirely avoided, in a kit containing straps for both belt and foot use. The straps are folded and packaged in a relatively small flexible, transparent bag which also includes direction for use of the contents.

DETAILED DESCRIPTION OF THE ILLUSTRATED EMBODIMENT OF THE INVENTION

Figure 1:
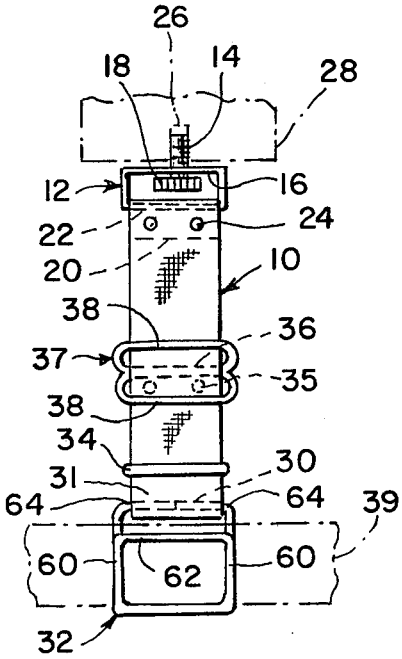
FIG. 1 is a view in front elevation of a waist length hold steady strap embodying the invention.

As shown in FIG. 1, a waist length hold steady strap 10, which is entirely composed of non-elastic webbing or woven material, is provided with a box-like bracket 12 at its upper end, having a freely rotatable screw 14 carried by the top cross member 16 of such bracket 12. The screw 14 is carried by a knurled finger wheel 18 located between such top cross member 16 and end portion 20 of the strap 10 that is looped over the bottom member 22 of the bracket 12 and riveted together at 24, thus connecting the bracket 12 to the upper end of strap 10. The screw 14 is adapted to fit a threaded opening 26 in a camera 28, by turning the wheel 18, to secure the bracket 12 to the camera for hand support at eye level by the user.

The other end portion of the woven fabric strap 10 is looped under the top 30 of a hook 32, where such loop 31 is closed on such top 30 by a flat ring keeper 34 which encompasses the loop adjacent the hook top 30. The very end portion of the loop 31 is in turn, looped around and riveted at 35 to the central cross member 36 of a slip buckle 37 having parallel slots 38, 38 for passage of the fabric strap 10 as the effective length of the strap 10 is adjusted for hooking the hook 32 under the users belt 39 when the camera 28 is to be held in front of the users face at eye level.

Figure 2:
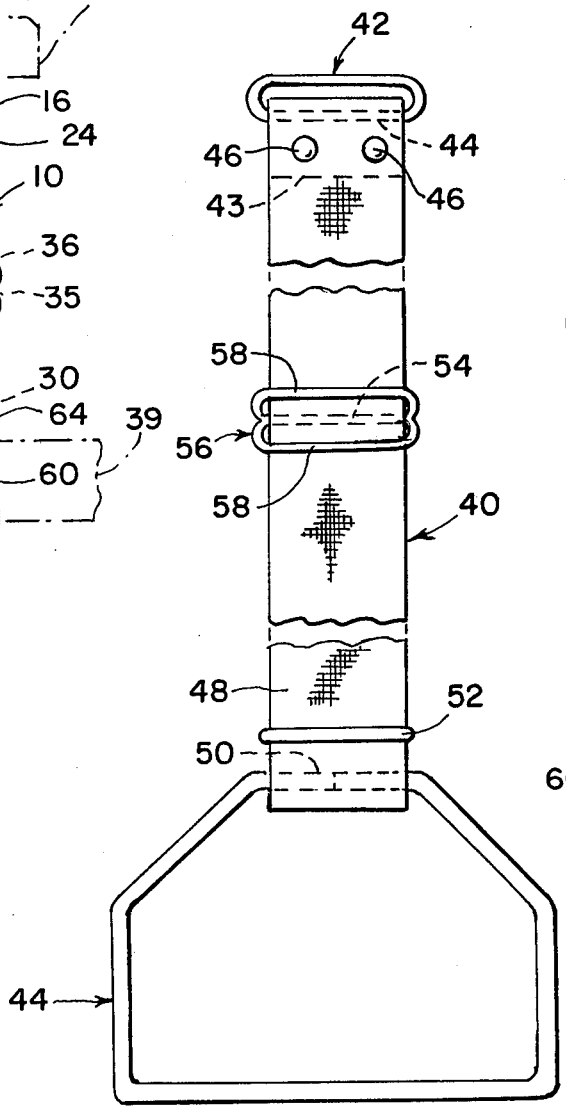
FIG. 2 is a similar view of a foot length extension therefor.

Referring to FIG. 2, an extension strap 40 is shown for converting the waist length strap 10, to reach to the user's foot. For this purpose the strap 40 is connected at the top to a flat ring 42 and at the bottom to a foot stirrup 44. The strap 40 consists of an entirely non-elastic woven fabric, the top end portion 43 of which is looped around the lower reach 44 of flat ring 42, and riveted at 46, 46. Similarly the bottom 48 is looped around the upper reach 50 of stirrup 44 and secured by an adjacent flat ring keeper 52. For adjusting the effective length of the extension 40, the end portion of loop 48 is looped around the central rung 54 of a sliding buckle 56 having horizontal slots 58, 58 for the passage of strap 40.

Figure 3:
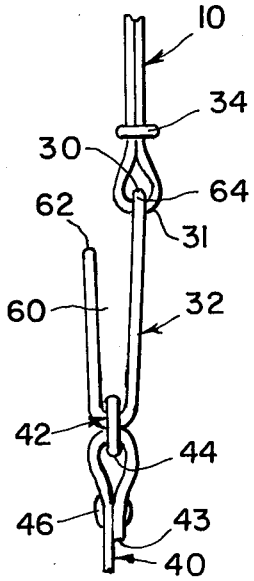
FIG. 3 is a view in side elevation of the foot length extension hooked on to the waist length strap.

In FIG. 3 the flat loop 42 at the top of foot extension strap, is shown hooked on the hook 32 at the lower end of the waist length strap for use by the foot of the user, instead of the latter's belt. The hook 32 consists of wire bent to form jaws 60, 60 which open upwardly, being connected by a cross bar 62 at the back, and by inwardly extending end portions 64, 64 which constitutes the top 30 of the hook 32.

Figure 4:
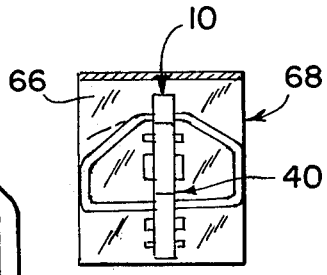
FIG. 4 is a view in front elevation of a kit embodying the invention.

The waist length strap 10 and foot extension strap 40 are folded about the stirrup 44, and inserted in a plastic container 66, FIG. 4, forming a compact kit 68 for the straps and associated hardware. In use, the straps 10 and 40 are removed from the transparent plastic container 66, which is a flexible bag, and used by connecting the screw 14 at the top of the waist length strap 10 to the camera 28 and connecting the hook 32 to the user's belt 39.

However, for extending the waist length strap 10 to the user's foot, flat ring 42 at the top of strap extension 40 is merely hooked on hook 32, FIG. 3, and the stirrup 44 is held under the user's foot. In either case, the lengths of the strap 10 and/or 40 are easily adjusted by means of the slip buckles 37 and 56 to fit the user's belt, and the user's foot distance from the camera, as the case might be. In use when a slight tension is felt upon raising the camera to eye level, the camera is horizontally steady.

What is claimed is:

1. A hold steady strap for a camera user while taking a picture at eye level, comprising:

a relatively short longitudinal non-elastic strap member composed entirely of woven fabric material attached at one end to a sliding buckle, slided on an intermediate portion of said strap member so as to form an adjustable loop at the lower end of said strap, a flat ring attached to the upper end of said strap, fitted with a freely rotatable screw adapted to fit a camera threaded opening, a hook having a base carried by said loop at the lower end of said strap member, adapted to fit under the user's belt, a flat ring keeper that is slidable on said adjustable loop for closing said loop on the base of said hook, an auxiliary relatively long extension non-elastic strap member comprised of woven fabric throughout attached at one end to a sliding buckle, slided on an intermediate portion thereof so as to form an adjustable loop at the lower end of said extension member, a flat loop attached to the upper end of said auxiliary strap member, for selective engagement with said hook on the lower end of said relatively short strap member, a foot stirrup formed of a wire piece bent to provide a shaft which is carried by the lower end of such loop, and a flat ring keeper slidable on said loop for closing such loop on the shaft of said foot stirrup, whereby the extension strap member can be connected to the relatively short strap member for extending the length of the strap to the user's foot, as desired.

2. A hold steady strap as defined by claim 1, in which said strap members and associated hardware are bundled and contained in a flexible, transparent plastic bag, which also includes directions for use of the contents.

* * * * *